US005096447A

United States Patent [19]

Uehara

[11] Patent Number: 5,096,447

[45] Date of Patent: Mar. 17, 1992

[54] TILTING MECHANISM FOR OUTBOARD DRIVE UNIT

[75] Inventor: Hidehiko Uehara, Hamamatsu, Japan

[73] Assignee: Sanshin Kogyo Kabushiki Kaisha, Hamamatsu, Japan

[21] Appl. No.: 660,283

[22] Filed: Feb. 22, 1991

[51] Int. Cl.[5] ..... B63H 5/06

[52] U.S. Cl. ..... 440/55; 440/63

[58] Field of Search ..... 440/53, 55, 56, 63, 440/65, 900

[56] References Cited

U.S. PATENT DOCUMENTS 3,835,807 9/1974 Kueny ..... 440/55

4,099,479 7/1978 Arimitsu ..... 440/63

*Primary Examiner*—Jesus D. Sotelo

*Attorney, Agent, or Firm*—Ernest A. Beutler

[57] ABSTRACT

A tilting mechanism including a tilt locking mechanism for releasably retaining an outboard drive unit in a tilted down position under normal running conditions and a tilt holding mechanism for releasably holding the outboard drive unit in a tilted up position is constructed and arranged so that a lever of the tilt locking mechanism lever and a holder arm of the holding mechanism pivot about a common axis, preferably about a single support shaft, on the swivel bracket.

17 Claims, 10 Drawing Sheets

*(A)*

*(B)*

TILTING MECHANISM FOR OUTBOARD DRIVE UNIT

BACKGROUND OF THE INVENTION

This invention relates to a tilting mechanism for an outboard drive unit, and more particularly to an improved tilt locking and holding mechanism which retains the drive unit in a tilted down position under normal running conditions but which permits the drive unit to pivot upwardly should the drive unit collide with an underwater obstacle, and which also holds the drive unit in a tilted up position when desired.

An outboard drive unit, which may comprise an outboard motor or the outboard drive portion of an inboard/outboard drive, typically employs an arrangement for supporting the drive unit for pivotal movement about a generally horizontally extending tilt axis. This pivotal movement is provided to adjust the trim of the drive unit to suit varied running conditions as well as to tilt up the drive unit to an out-of-the-water position for servicing, storage, trailering or the like. It is also conventional practice to employ some form of mechanical locking and holding mechanism to maintain the outboard drive unit in the tilted down position under normal running conditions and to hold the outboard drive in its tilted up position when desired.

One such mechanism employs an engaging arm which is affixed to a swivel bracket of the drive unit and is adapted to releasably engage a pin on the clamp bracket of the drive unit. A lever, which is pivotally supported on the swivel bracket by means of a support shaft, is connected to the engaging arm by a link and is adapted to be pivoted by means of an operating lever also attached to the support shaft to actuate the engaging arm. A holder arm is also pivotally supported on the swivel bracket by means of another shaft and is engagable with a holder portion of the clamp bracket for holding the outboard drive unit in a tilted up state. Although this type of mechanism is generally satisfactory, the use of different shafts for the engaging arm lever and the holder arm makes the layout and assembly of the tilting mechanism difficult and relatively complicated, since these components must be installed in a relatively small space on the swivel bracket.

It is, therefore, a principal object of this invention to provide an improved tilting mechanism for an outboard drive unit which includes both a tilt locking and holding mechanism and which is more simply arranged and constructed and yet highly effective in operation.

It is a further object of this invention to provide a tilting mechanism for an outboard drive unit wherein a lever of the tilt locking mechanism and a holder arm of the tilt holding mechanism both pivot about a common axis.

SUMMARY OF THE INVENTION

This invention is adapted to be embodied in a tilting mechanism for an outboard drive unit that comprises a clamp bracket having a holder portion and which is adapted to be affixed to the transom of an associated watercraft. A swivel bracket is pivotally connected to the clamp bracket for tilting movement about a tilt shaft between a tilted down position and a tilted up position. The clamp bracket has a stop member secured to it which is engagable with the swivel bracket for setting a tilted down position of the swivel bracket and the outboard drive unit. There is provided means for releasably retaining the swivel bracket in a tilted down position and which comprises at least one engaging arm pivotally mounted on the swivel bracket and having a recessed portion for selectively engaging the stop member. This retaining means further comprises a first lever pivotally supported on the swivel bracket and means for connecting the engaging arm with the first lever. The tilting mechanism further includes means for releasably holding the swivel bracket in a tilted up position. This releasable holding means comprises a second lever which is pivotally supported on the swivel bracket and a holder arm pivotally supported on the swivel bracket and selectively engagable with the holder portion of the clamp bracket. In accordance with the invention, the first lever and the holder arm are arranged so that they pivot about a common axis, preferably about a single support shaft. An operating lever is supported on the support shaft for operating the retaining and holding means.

In a second embodiment, a handle is connected to the first and second levers by a pair of links respectively and is rotatably supported on the tilt shaft for operating the retaining and holding means. The operating lever is adapted to operate only the holding means.

A handle is also employed in a third embodiment but is connected only to the first lever by means of a link. As such, the handle is rotatably supported on the tilt shaft for operating the retaining means only. The operating lever may be used for operating the holding means but not the retaining means.

A fourth embodiment of the tilting mechanism employs an arcuate link for connecting the second lever to a spring which is connected at the other end to a holder arm of the holding means. In addition, the upper end of a release link which is connected to the first lever for actuating the engaging arm is of arcuate shape. This arrangement allows the operating lever to be fully rotated to operate the retaining and holding means.

A fifth embodiment is generally similar to the third embodiment, except that there is an arcuate link for connecting the second lever to a spring which is connected at the other end to a holder arm of the holding means so that the operating lever may be fully rotated to operate the holding means only.

DETAILED DESCRIPTION OF THE PREFERRED EMBODIMENTS OF THE INVENTION

Figure 1:
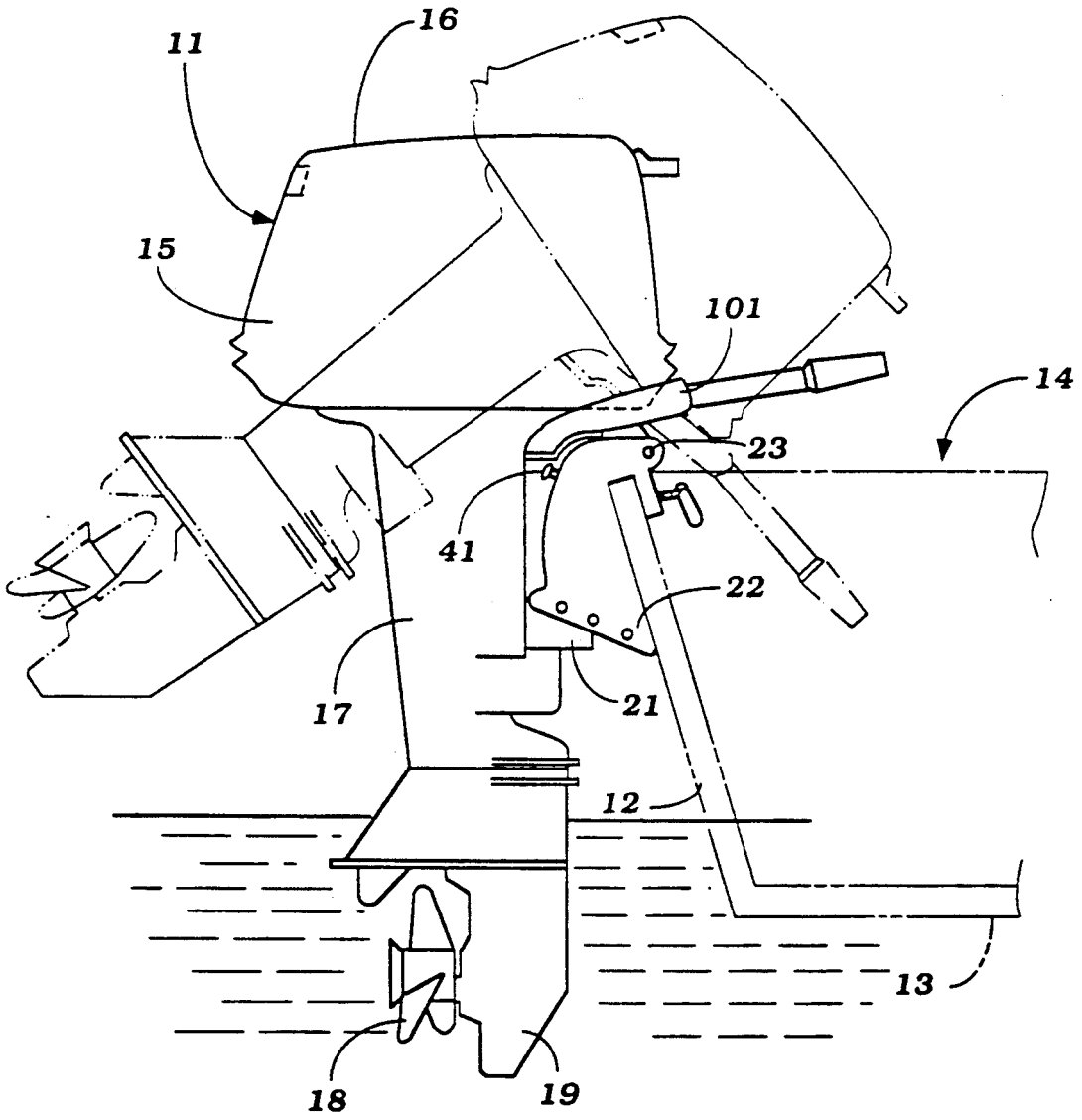
FIG. 1 is a side elevational view of an outboard motor, attached to the transom of an associated watercraft, shown in the tilted down position in solid lines and in the tilted up position in phantom, and embodying a tilting mechanism constructed in accordance with a first embodiment of the invention.

Referring first to FIG. 1, an outboard drive unit in the form of an outboard motor, indicated generally by the reference numeral 11 and constructed in accordance with an embodiment of the invention, is mounted on a transom 12 of a hull 13 of an associated watercraft 14. Although the invention is described in conjunction with an outboard motor, it is to be understood that the invention may equally as well be practiced with the outboard drive portion of an inboard/outboard drive. However, the invention has particular utility in connection with an outboard motor.

The outboard motor 11 is comprised of a power head, indicated generally by the reference numeral 15, which includes an internal combustion engine (not shown) and a surrounding protective cowling, identified by the reference numeral 16. The engine, which may be of any conventional type, has an output shaft that drives a driveshaft journaled for rotation within a driveshaft housing 17 and which drives a propeller 18 of a lower unit 19 through a conventional forward, neutral, reverse transmission (not shown).

A steering shaft 100 is affixed to a steering bracket 101 and is journaled for steering movement about a generally vertically extending steering axis within a swivel bracket 21. The swivel bracket 21 is, in turn, connected for pivotal movement to a clamp bracket 22 by means of a tilt shaft 23 for tilt and trim adjustment of the outboard motor 11.

Referring now to FIGS. 2 through 5, in addition to FIG. 1, the clamp bracket 22 has a series of trim apertures extending laterally therethrough for receiving a stop pin 24 for setting the tilted down position of the swivel bracket 21 and outboard motor 11. Thus, the angle of the outboard motor 11 with respect to the transom 12 of the watercraft 14 may be selectively varied by the operator in accordance with desired operating conditions by inserting the stop pin 24 in the appropriate aperture in the clamp bracket 22.

Figure 2:
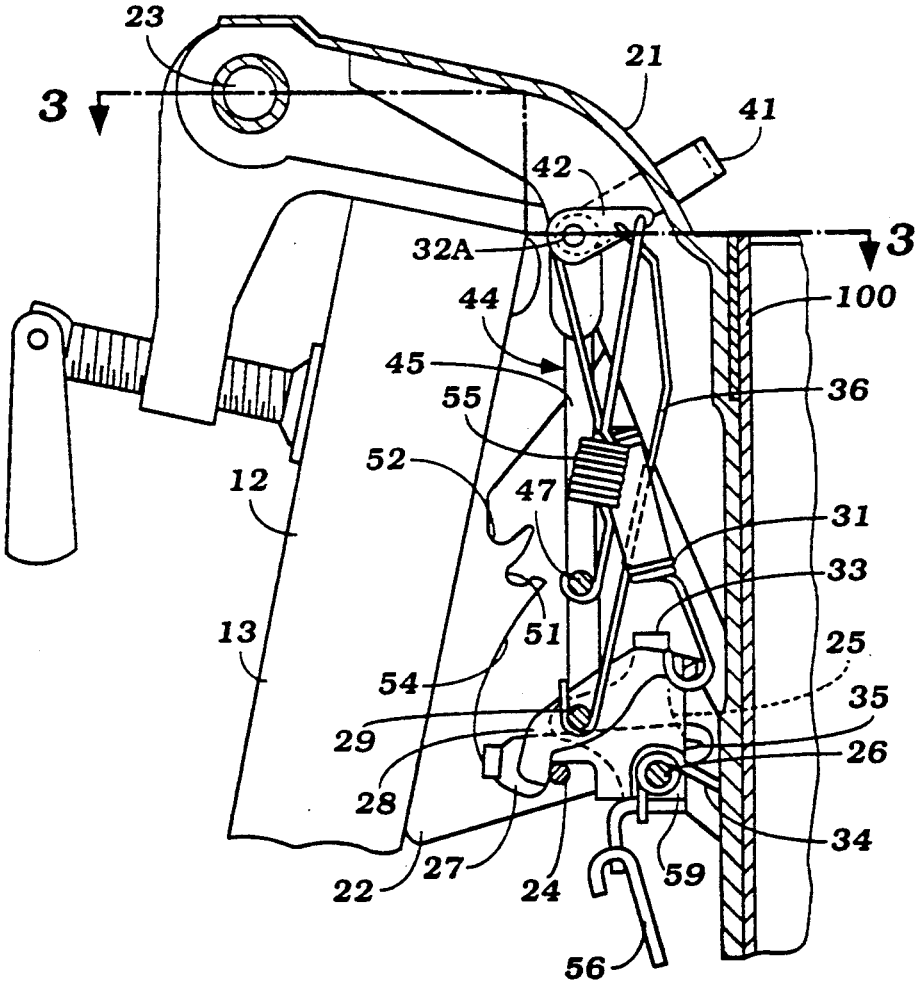
FIG. 2 is an enlarged side elevational view of the first embodiment of the tilting mechanism, showing the swivel bracket in its tilted down, locked state.
Figure 3:
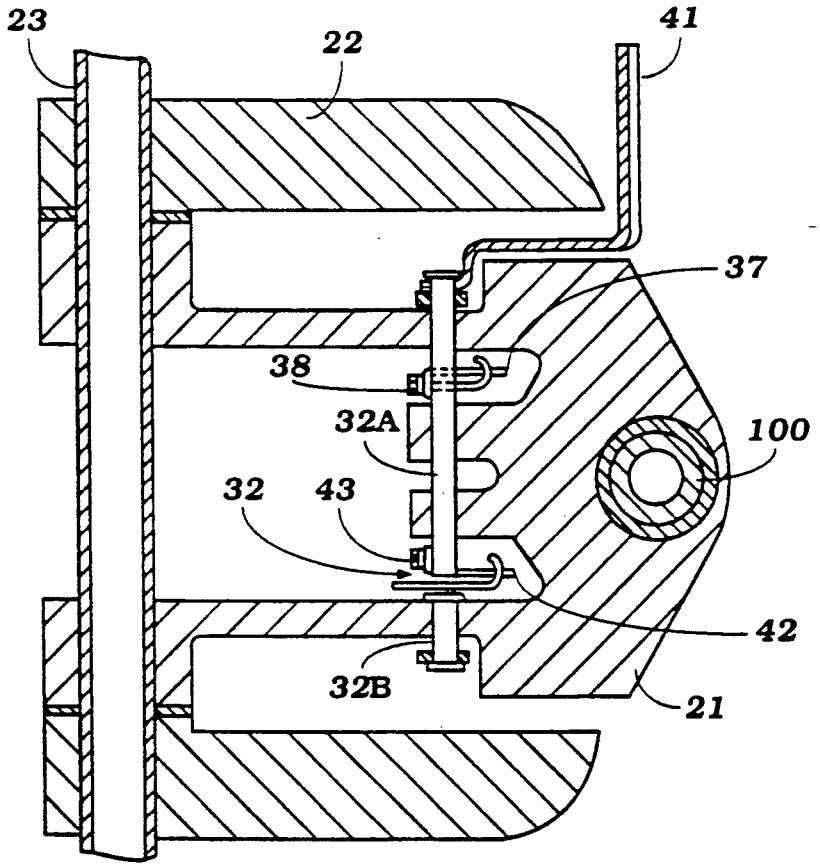
FIG. 3 is a cross sectional view taken along the line 3—3 and FIG. 2.

In accordance with the invention, retaining means are provided on the swivel bracket 21 for releasably engaging the stop pin 24 to retain the swivel bracket 21 and outboard motor 11 in the tilted down position under normal running conditions of the motor 11 and to prevent the motor 11 from popping up when operating in reverse. This releasable retaining means comprises levers 25 which are pivotally mounted on the swivel bracket 21 by means of a pivot pin 26. Engaging arms 27 and 28 are positioned in proximity to the lever 25. The first engaging arms 27 are mounted for pivotal movement about the pivot pin 26, while the second engaging arm 28 is secured to the lever 25 by means of a pin 29 that is carried on the lever 25. Each of these engaging arms 27 and 28 defines a recess that is adapted to selectively engage the stop pin 24 for setting the tilted down position of the swivel bracket 21 and outboard motor 11 and for retaining the motor 11 in a selected downward running position, as shown in FIG. 2. A spring 31 is connected between the end of the engaging arm 28 opposite the pin 24 and a support shaft 32. This spring 31 exerts an upward force on the end of the engaging arm 28 opposite the pin 24 which causes an upper surface of the engaging arm 28 opposite the pin 24 to forcibly bear against a tang 33 formed on lever 25 to hold the engaging arm 28 in its locked position under normal forward running conditions. When the outboard motor 11 is operating in reverse, the engaging arms 27 are also held in their locked positions against the force of spring 34 by means of a spring 35 as hereinafter described.

Figure 4:
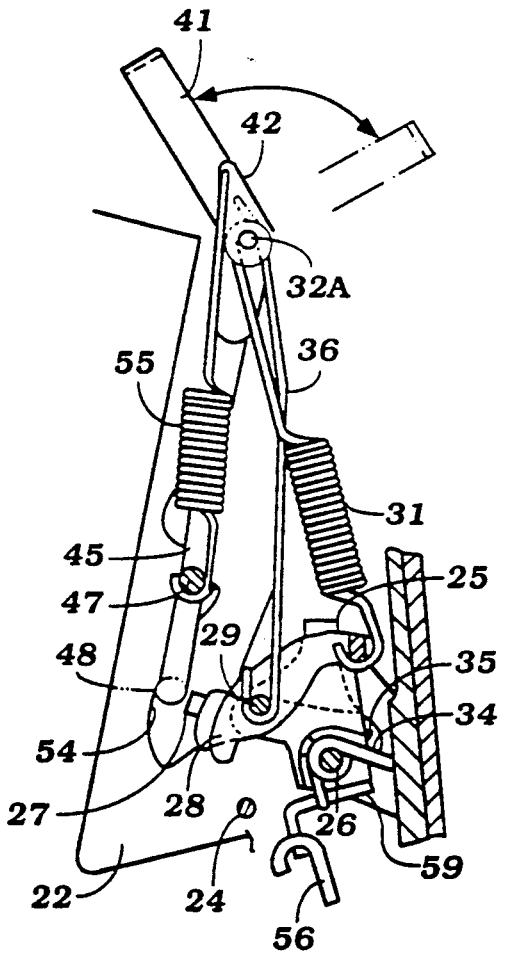
FIG. 4 is an enlarged side elevation view of the first embodiment of the tilting mechanism, with the swivel bracket in the tilted down, released position.

A release link 36 is connected at its lower end to the pin 29 and at its upper end to a first lever 37 which is mounted by means of a bolt 38 on the long portion 32A of the support shaft 32 that is rotatably supported by the swivel bracket 21. This release link 36 and first lever 37 are adapted for manually releasing the engaging arm 28 to permit tilting up of the outboard motor 11. To accomplish this, an operating lever 41, which is supported on the long portion 32A of the support shaft 32, is rotated counterclockwise, as shown in FIG. 4. This, in turn, causes the first lever 37 to rotate in a counterclockwise direction along with the long portion 32A of the support shaft 32. Rotation of the first lever 37 in this manner places a tension on the release link 36 to draw the levers 25 and engaging arm 28 in an upward direction to release the engaging arm 28 from the stop pin 24. The engaging arms 27 are released from their locked positions under forward or neutral operating conditions. Thus, in addition to actuating release link 36, a shift mechanism to be described must be in its forward or neutral position before the swivel bracket 21 and outboard motor 11 may be tilted up.

In addition to releasable retaining means, the tilting mechanism is also equipped with means for holding the swivel bracket 21 and outboard motor 11 in a desired tilted up position. This holding means cooperates with the retaining means and is comprised of a second lever 42 which, like the first lever 37, is mounted by means of a bolt 43 on the long portion 32A of the support shaft 32 for rotation therewith. This holding means further comprises a holder arm 44 which includes a pair of generally L-shaped members 45 that are each mounted at one end on the long and short portions 32A and 32B of the support shaft 32 respectively for independent rotation with respect thereto. These L-shaped members 45 are interconnected by a rod 47 so that they will pivot as a unit. Each of these links 45 has a horizontal segment 48 at its other end which extends outwardly in the opposite direction from its counterpart. These horizontal segments 48 are selectively engagable with a series of holder portions or recesses 51, 52 and 53 formed in rearwardly extending plate portions 54 of the clamp bracket 22.

Figure 5:
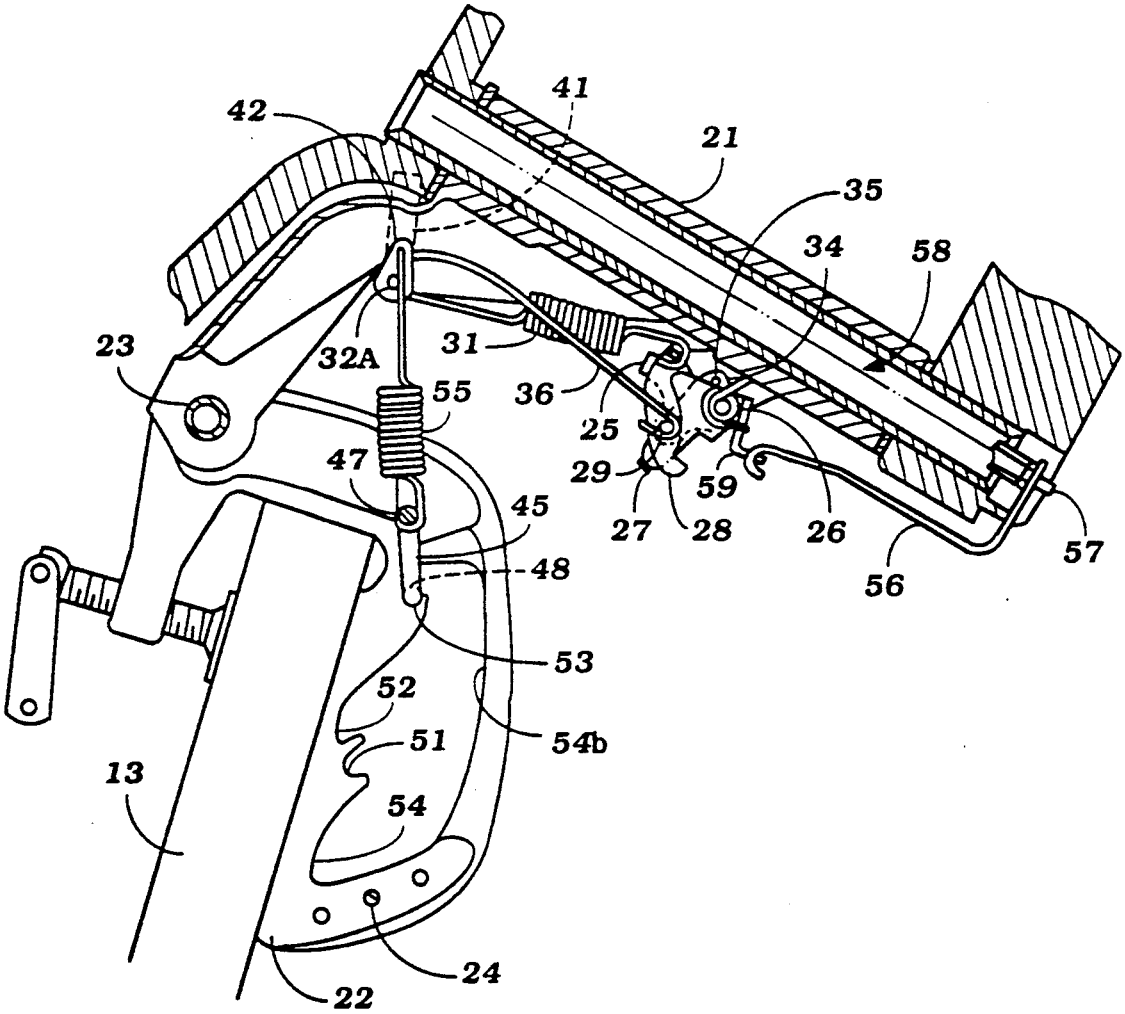
FIG. 5 is an enlarged side elevational view of the first embodiment of the tilting mechanism, showing the swivel bracket being held in the tilted up position.

The holder arm 44 is actuated in conjunction with the release of the engaging arm 28. Hence, as the operating lever 41 is rotated counterclockwise as shown in FIG. 4, the second lever 42 rotates in that same direction along with the long portion of the support shaft 32A. When this occurs, a compression spring 55, which extends between the second lever 42 and the rod 47, swings from the position shown in FIG. 2 to the position illustrated in FIG. 4. This movement, in turn, causes the holder arm 44 to pivot toward the clamp bracket 22 so that the horizontal segments 48 rise along the plate portions 54 and are in position to engage one of the recesses 51, 52 or 53 when the outboard motor 11 is tilted-up. The outboard motor 11 may then be lowered slightly so that the horizontal segments 48 will engage one of the clamp bracket recesses 51, 52 or 53 and hold the swivel bracket 21 and outboard motor 11 in a selected tilted up position. FIG. 5 shows the outboard motor 11 and swivel bracket 21 in their fully tilted up state, wherein the horizontal segments 48 are engaged with the upper recess 53.

To lower the outboard motor 11, it is raised slightly and the operating lever 41 is rotated in a clockwise direction toward the locked position enough to release the holder arm 44 from the clamp bracket recess 51, 52 or 53 so that the outboard motor 11 may be returned to a normal tilted down running position wherein the segments 48 go down along plate portions 54*b*. Once the stop pin 24 is engaged by the engaging arm 28 within its recess, the operating lever 41 is then rotated further in the clockwise direction to its locked position to retain the outboard motor 11 in the selected tilted down running position.

As previously noted, the retaining means of the tilting mechanism is adapted for retaining the swivel bracket 21 and outboard motor 11 in the tilted down position under normal running conditions and when the motor 11 is operated in reverse and may be manually released by movement of the operating lever 41. However, in the event that the lower unit 19 of the outboard motor 11 strikes a submerged obstacle with sufficient force, the outboard motor 11 is permitted to pop up through automatic mechanical release of the retaining means. To this end, a lever 59 is pivotally mounted on the swivel bracket 21 by means of pivot pin 26. A connecting link 56 connects the lever 59 and a shifting mechanism 57 which is mounted to the bottom of the swivel bracket 21.

The shifting mechanism 57 is movable between reverse, neutral and forward positions which correspond to the transmission positions of the outboard motor 11.

When the shifting mechanism 57 is in the reverse position, the lever 59 is turned fully against the force of spring 34, one end of which is engaged with the lever 59 and the other end of which is engaged with the swivel bracket 21. In reverse, the lever 59 exerts a counterclockwise force on spring 35 which then holds the engaging arms 27 in the down position by torsional force. Thus, in the reverse condition, engaging arms 27 and 28 engage with the stop pin 24 to retain the swivel bracket 21 and outboard motor 11 in the tilted down position so that the motor 11 does not pop up as a result of the reverse thrust of the propeller 18.

When the shifting mechanism 57 is moved to the neutral position, the lever 59 is rotated back in a clockwise direction approximately half way by the force of spring 34 so that the engaging arms 27 are positioned in the unlocked or up position.

When the shifting mechanism 57 is in the forward position, the lever 59 is rotated further in the clockwise direction, although the engaging arms 27 are maintained in the up position. The engaging arm 28, however, is engaged with the stop pin 24 to maintain the swivel bracket 21 and outboard motor 11 in the tilted down position under normal forward running conditions and is also able to prevent the motor 11 from tilting up during deceleration. However, the engaging force of arm 28 is relatively weak so that when the outboard motor 11 strikes an underwater obstacle, the motor 11 may pop up against the engaging force of arm 28 to eliminate, or at least minimize, damage to the outboard motor 11.

Second, third, fourth and fifth embodiments of the tilting mechanism are illustrated in the remaining FIGS. 6 through 10. The tilting mechanism of each of these embodiments is generally similar to the tilting mechanism described in connection with the first embodiment and, for that reason, components of these additional embodiments which are the same as components of the first embodiment are identified by the same reference numerals and will not be described again, except insofar as is necessary to understand the construction and operation of these other embodiments.

Figure 6:
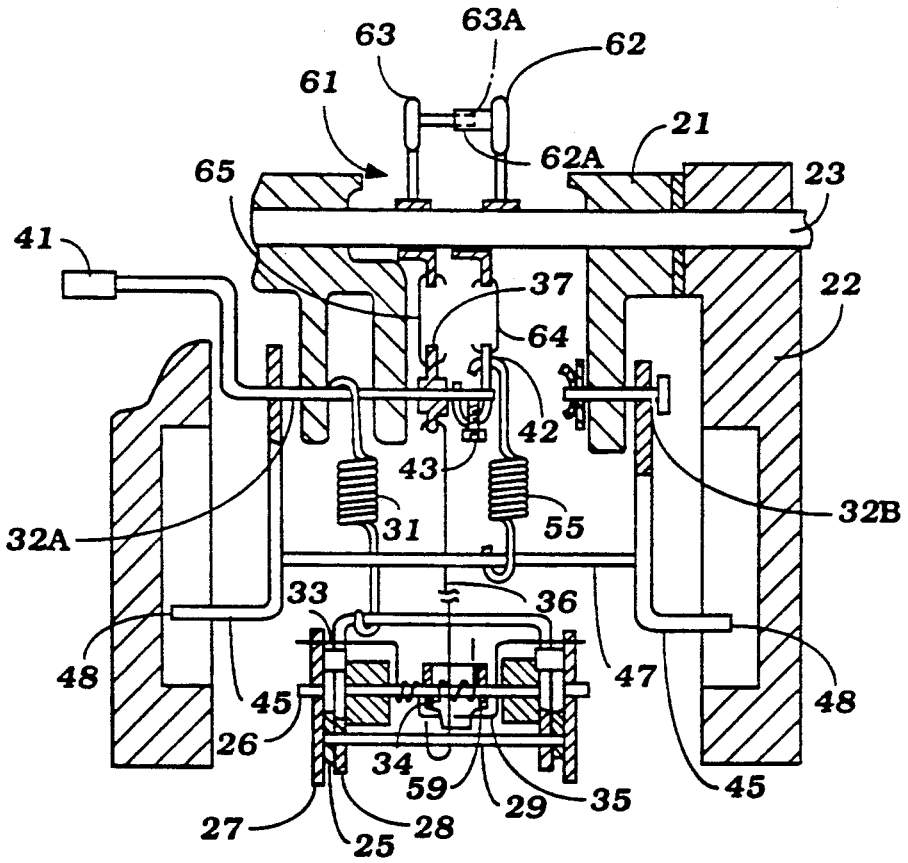
FIG. 6 is an enlarged rear elevational view, with portions broken away and other portions shown in cross-section, of a second embodiment of the tilting mechanism.
Figure 7:
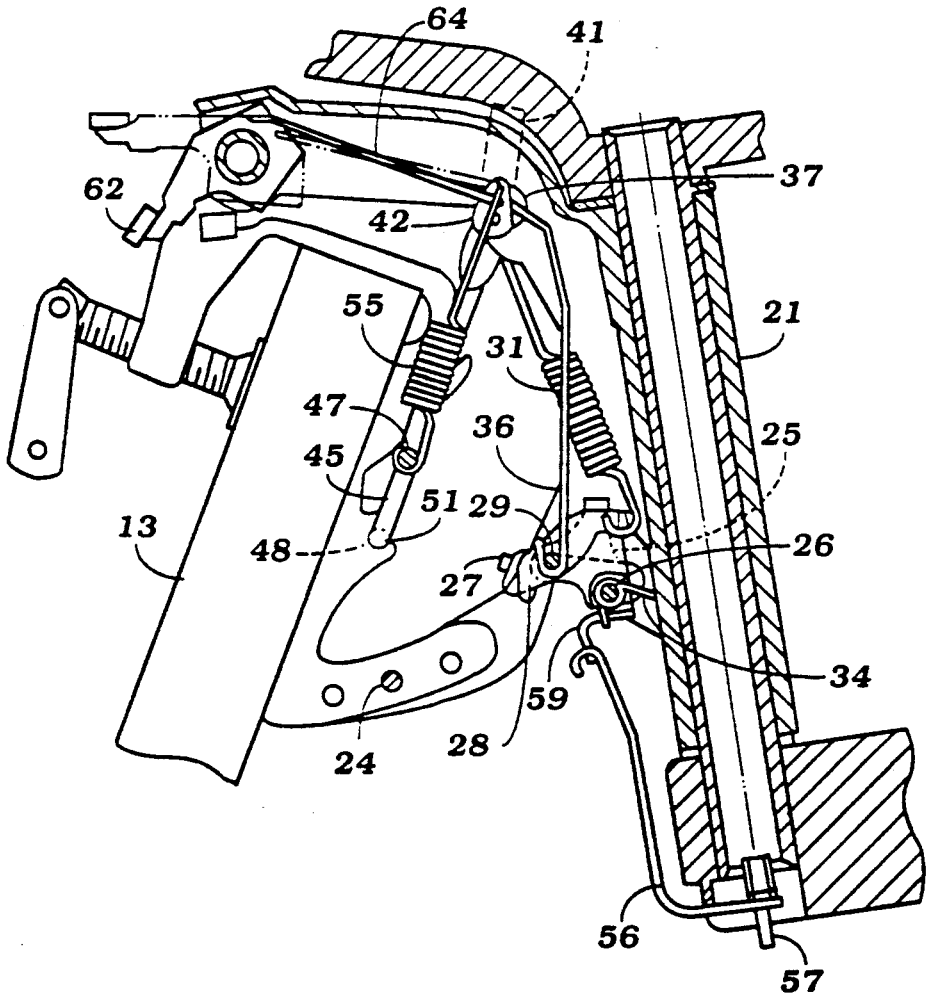
FIG. 7 is an enlarged side elevational view of the second embodiment of the tilting mechanism, showing the swivel bracket and outboard motor being held at the shallow running position.

Referring now to FIGS. 6 and 7, a second embodiment of the tilting mechanism is depicted. In this second embodiment, a handle, indentified generally by the reference numeral 61, is provided for operating the retaining and holding means of the tilt mechanism. This handle 61 is comprised of a pair of upstanding members 62 and 63 which are rotatably supported on the tilt shaft 23 and which extend in a generally forward direction from the tilt shaft 23 as depicted in FIG. 7. Each member 62 and 63 has a cross segment 62A and 63A formed at its end opposite the tilt shaft 23. These cross segments 62A and 63A extend toward each other for interconnecting the members 62 and 63. As shown in FIG. 6, cross segment 62A has a larger diameter than segment 63A and also has an axially extending bore formed in its inner end for receiving the inner end of cross segment 63A to form the connection.

A pair of links 64 and 65 are provided for actuating the first and second levers 37 and 42. Link 64 interconnects handle member 62 with second lever 42 while link 65 interconnects member 63 with first lever 37 so that the retaining and holding means may be operated by rotation of the handle 61. It should be noted that in this second embodiment, unlike in the first embodiment, the first lever 37 is not affixed to the long portion of the support shaft 32A for rotation therewith but rather is rotatably supported on the support shaft portion 32A for independent rotation with respect thereto. Accordingly, although the handle 61 can be used to actuate both the retaining and holding means, the operating lever 41 can only be used to actuate the holding means.

Figure 8:
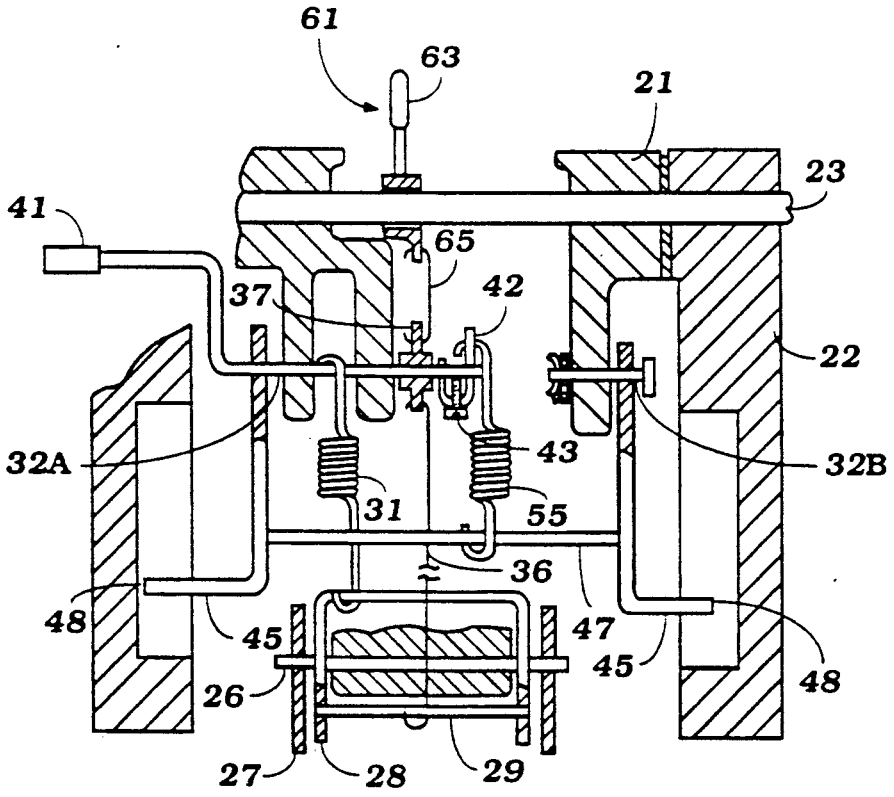
FIG. 8 is an enlarged rear elevational view, with portions broken away and other portions shown in cross-section, of a third embodiment of the tilting mechanism.
Figure 9:
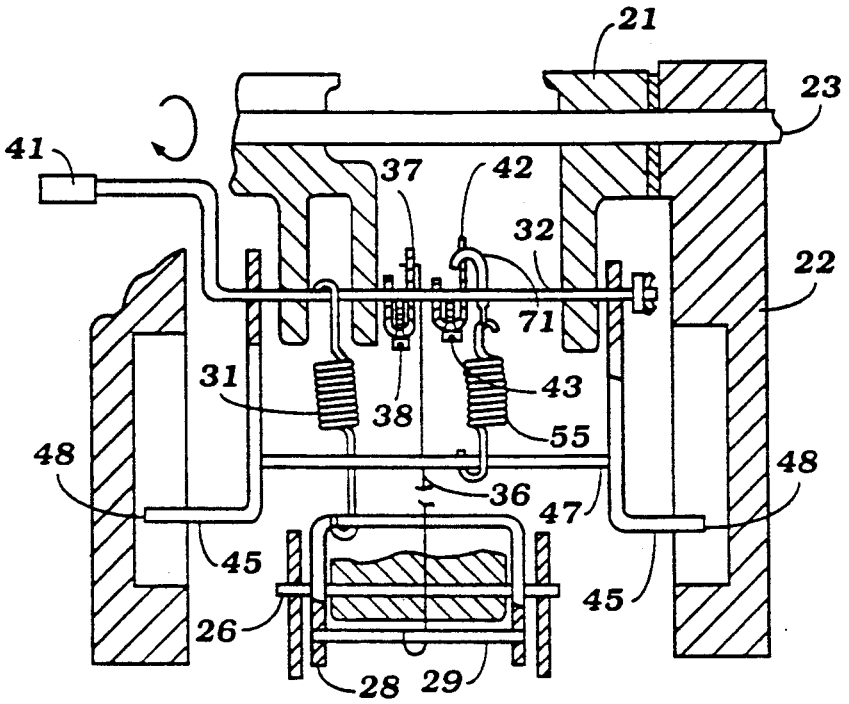
FIG. 9A is an enlarged rear elevational view, with portions broken away and other portions shown in cross-section, of a fourth embodiment of the tilting mechanism.
FIG. 9B is an enlarged side elevational view of the fourth embodiment, showing the connections between the first and second levers and the retaining and holding means respectively.
Figure 9:
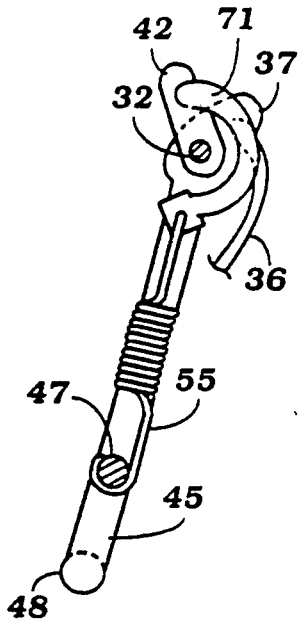

In FIG. 8, a third embodiment of the tilting mechanism is shown which provides for operation of the retaining means independently of the holding means. Like the second embodiment, this third embodiment also includes the handle 61, except that in this third embodiment it is comprised of only one forward standing member 63 which is rotatably supported about the tilt shaft 23 and which is connected only to the first lever 37 by means of link 65 for operation of the retaining means only. In this third embodiment, the operating lever 41 is used to operate the holding means only, since the first lever 37 is not connected for rotation with support shaft portion 32A.

FIGS. 9A and 9B show a fourth embodiment of the invention which is the similar to the first embodiment, except that the support shaft 32 is of one piece construction. Also, unlike the first embodiment, the spring 55 is connected to the second lever 42 by means of an arcuate link 71 and the upper end of link 36 where it connects with first lever 37 is of arcuate shape so that the operating lever 41 may be fully rotated in the same direction without interference from the support shaft 32.

Figure 10:
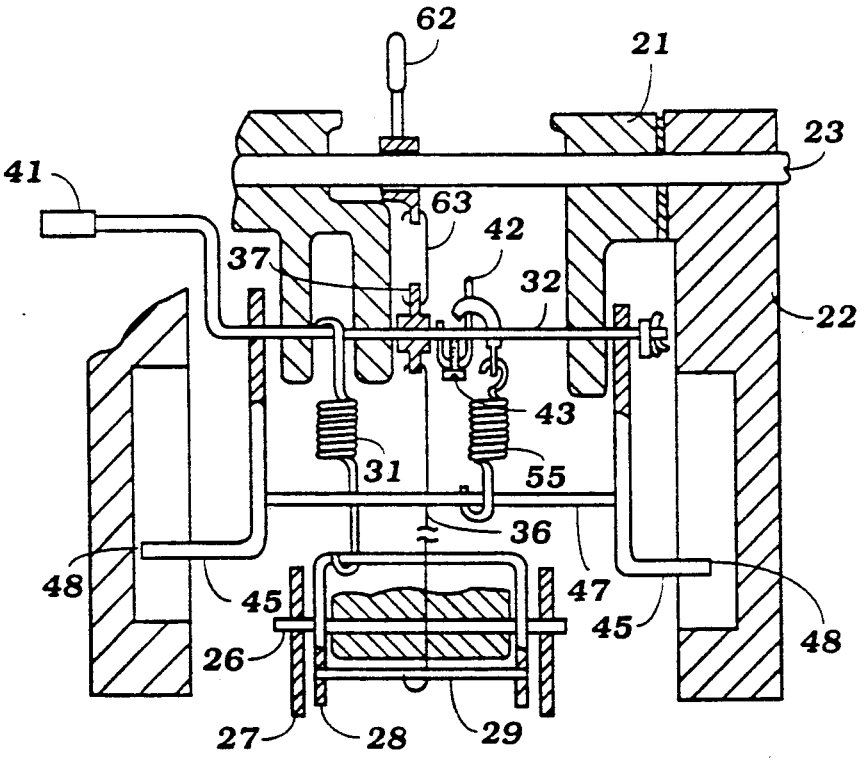
FIG. 10 is an enlarged rear elevational view, with portions broken away and other portions shown in cross-section, of a fifth embodiment of the tilting mechanism.

In FIG. 10, a fifth embodiment is depicted which is similar to the third embodiment, except that the support shaft 32 is one piece and there is an arcuate link which interconnects spring 55 with second lever 42 so that operating lever 41 may be fully rotated to operate the holder arm 44 between a released and hold position.

It should be readily apparent from the foregoing description that several embodiments of a highly effective yet simple and compact tilt retaining and holding mechanism have been illustrated and described. Although this is the case, it is to be understood that various changes and modifications may be made without departing from the spirit and scope of the invention, as defined by the appended claims.

I claim:

1. A tilting mechanism for an outboard drive unit comprising a clamp bracket having a holder portion and adapted to be affixed to the transom of an associated watercraft, a tilt shaft, a swivel bracket pivotally connected to said clamp bracket for tilting movement about said tilt shaft between a tilted down position and a tilted up position, a stop member secured to said clamp bracket and engagable with said swivel bracket for setting a tilted down position of said swivel bracket, means for releasably retaining said swivel bracket in a tilted down position comprising at least one engaging arm pivotally mounted on said swivel bracket and having a recessed portion for selectively engaging said stop member, a first lever pivotally supported on said swivel bracket and means connecting said engaging arm with said first lever, means for releasably holding said swivel bracket in a tilted up position comprising a second lever pivotally supported on said swivel bracket and a holder arm pivotally supported on said swivel bracket and selectively engagable with the holder portion of said clamp bracket, wherein said first lever and said holder arm pivot about a common axis.

2. A tilting mechanism as recited in claim 1, further comprising a support shaft wherein said first lever and said holder arm are both supported on said support shaft.

3. A tilting mechanism as recited in claim 2, wherein said first lever and said second lever are supported on said support shaft for rotation therewith.

4. A tilting mechanism as recited in claim 3, further comprising an operating lever supported on said support shaft for operating said retaining and holding means.

5. A tilting mechanism as recited in claim 2, wherein said means connecting said engaging arm with said first lever comprises a release link.

6. A tilting mechanism as recited in claim 5, further comprising a spring for connecting said holder arm with said second lever.

7. A tilting mechanism as recited in claim 6, further comprising an arcuate link for connecting said second lever with said spring and wherein said release link has an upper portion of arcuate shape connected to said first lever.

8. A tilting mechanism as recited in claim 1, further comprising a handle and a pair of links each connected at one of its ends to said handle, one of said links being connected at its other end to said first lever and the other of said links being connected at its other end to said second lever, said handle being rotatably supported on said tilt shaft for operating said retaining and holding means.

9. A tilting mechanism as recited in claim 8, further comprising a support shaft wherein said first lever and said holder arm are both supported on said support shaft.

10. A tilting mechanism as recited in claim 9, wherein said first lever is supported on said support shaft for independent rotation with respect thereto and said second lever is supported on said support shaft for rotation therewith.

11. A tilting mechanism as recited in claim 9, further comprising an operating lever supported on said support shaft for operating said holding means only.

12. A tilting mechanism as recited in claim 1, further comprising a handle and a link for connecting said handle to said first lever, said handle being rotatably supported on said tilt shaft for operating said retaining means only.

13. A tilting mechanism as recited in claim 12, further comprising a support shaft wherein said first lever and said holder arm are both supported on said support shaft.

14. A tilting mechanism as recited in claim 13, wherein said first lever is supported on said support shaft for independent rotation with respect thereto and said second lever is supported on said support shaft for rotation therewith.

15. A tilting mechanism as recited in claim 13, further comprising an operating lever supported on said support shaft for operating said holding means only.

16. A tilting mechanism as recited in claim 1, further comprising a handle and a link for connecting said handle to said first lever, said handle being rotatably supported on said tilt shaft for operating said retaining means only, said tilting mechanism further comprising an arcuate link for connecting said second lever with said spring.

17. A tilting mechanism as recited in claim 16, further comprising an operating lever supported on said support shaft for operating said holding means only.

* * * * *